US005529781A

United States Patent [19]

Kamen et al.

[11] Patent Number: 5,529,781

[45] **Date of Patent: * Jun. 25, 1996**

[54] COSMETIC COLOR DISPLAY APPARATUS AND METHODS

[75] Inventors: Melvin E. Kamen, Highlands; Philip Bernstein, Glen Ridge; Rene T. Rivero, West New York, all of N.J.

[73] Assignee: Revlon Consumer Products Corporation, New York, N.Y.

[ * ] Notice: The portion of the term of this patent subsequent to Feb. 1, 2011, has been disclaimed.

[21] Appl. No.: 850,472

[22] Filed: Mar. 12, 1992

Related U.S. Application Data

[60] Division of Ser. No. 548,659, Jul. 5, 1990, Pat. No. 5,283,061, which is a continuation-in-part of Ser. No. 329,659, Mar. 28, 1989, abandoned.

[51] Int. Cl.[6] ..... A45D 34/00

[52] U.S. Cl. ..... 424/400; 424/63; 424/64; 424/100; D28/87

[58] Field of Search ..... 424/63, 64, 400, 424/100; D28/85–87

[56] References Cited

U.S. PATENT DOCUMENTS

| | | | |
|---|---|---|---|
| 3,088,585 | 6/1960 | Solenghi | 434/100 |
| 4,919,934 | 4/1990 | Deckner et al. | 424/401 |
| 4,957,949 | 9/1990 | Kamada et al. | 524/487 |

*Primary Examiner*—Edward J. Webman
*Attorney, Agent, or Firm*—Julie Blackburn

[57] ABSTRACT

A color display facsimile of a cosmetic product comprised of the formulation of an original cosmetic product and prescribed amounts of each of a thermoplastic, copolymeric hardening agent and a hydrocarbonous-based temperature control component. The resultant display facsimile is capable of exhibiting the exact-likeness characteristics of true color, size, and shape of the original cosmetic product. The method for preparing said color display facsimile is also disclosed.

6 Claims, 1 Drawing Sheet

COSMETIC COLOR DISPLAY APPARATUS AND METHODS

CROSS-REFERENCE TO RELATED APPLICATIONS

This is a divisional of application Ser. No. 07/548,659 filed on Jul. 5, 1990, now U.S. Pat. No. 5,283,061, which is a continuation-in-part of application Ser. No. 07/329,659, filed Mar. 28, 1989, now abandoned.

FIELD OF THE INVENTION

This invention relates to cosmetic color display apparatus, in general, and, more particularly, to exact-likeness facsimiles of cosmetic products and to the methods of preparing them.

BACKGROUND OF THE INVENTION

Cosmetics have been used since early times to beautify the skin and hair. The manufacture of cosmetics is a 20th century development under the influence of Hollywood in the 1920's coupled with the development of mass production and mass marketing techniques. As a consequence, cosmetics were offered to the public at relatively low prices. As one can ascertain, the cosmetic industry today is huge, and there are a tremendous number of products utilized.

As is well known, a very important aspect of the entire cosmetic industry is the preparation and distribution of various cosmetic products which contain color. For example, various lipsticks, powders, eye make-ups, and so on are available in a wide variety of colors.

As one can further ascertain, it is extremely difficult to accurately represent such colors in advertisements or elsewhere. Such colors, as available in a complete line of lipsticks or other lines of cosmetics products, had to be portrayed by various means to show all the various available colors. These means involve photographic or other techniques which attempted to show the different colors by charts, in order to inform the consumer of the available colors of the respective products.

Face powders, lipsticks, and nail polishes are examples of cosmetic products which contain coloring materials of various kinds. As one can ascertain, the color of cosmetics, especially in regard to lipsticks and nail polishes, is extremely important, and there are a wide variety of colors and shades employed. Due to the wide variety of colors, the display of such colors has been extremely difficult. In order to determine color, one would ordinarily refer to a color chart.

Coloring materials, for example, which are employed with face powders are either natural ground earth colors or certified organic colors. The fact that color is considered the primary factor in cosmetic products such as lipsticks and face powders is well known. Thus, the art of providing colors and the utilization of various pigments and various substances is an extremely important art, and many companies have proprietary color formulations which have been developed extensively.

It is difficult and expensive to accurately display the color of the product on various containers and so on by using conventional techniques. In this regard, each and every container would have to have either a photograph or some kind of color coordinated area which shows the color of the cosmetic product included within the container. This color can, of course, vary from batch to batch and may vary widely depending upon the blending process and so on. Hence, a prior art display of color is not accurate, due to the many factors which can effect the color presented on the display as compared to the color presented on the product.

The need for exact-likeness display facsimiles has, for the most part, consistently grown with the demands for such articles by an ever-increasingly health conscious society. For instance, community-type cosmetic product samplers can promote the spread of germs, and therefore, they present a contamination problem which makes their continued use by the public less desirable.

SUMMARY OF THE INVENTION

The present invention relates to the fabrication of exact-likeness facsimiles of cosmetic products, wherein a quantity of the complete formulation of the actual product is admixed with a thermoplastic copolymer hardening agent consisting of a copolymer of ethylene and a mono-substituted vinyl comonomer, in combination with a hydrocarbonous-based temperature control component, to form a composition which is then molded into the shape of the original product. The quantity of the formula of the cosmetic product utilized is sufficient to reflect the true color of the original cosmetic product. Obviously, the molded facsimile, in accordance with this invention, can also be the exact size and shape of the original product, when a production size mold is utilized. Accordingly, the present invention offers an accurate cosmetic color display apparatus which actually appears the same, in all respects, as the original product, such as, for example, a lipstick or a compacted powder. Because the present invention functions as a facsimile or display, it does not yield a payoff as would the original product, thereby deterring its use as a community-type sampler and hence mitigating the contamination problem associated therewith.

BRIEF DESCRIPTION OF THE DRAWINGS

For a better understanding of the present invention, reference is made to the following detailed description of various exemplary embodiments considered in conjunction with the accompanying drawings, in which.

DETAILED DESCRIPTION OF THE INVENTION

Figure 1:
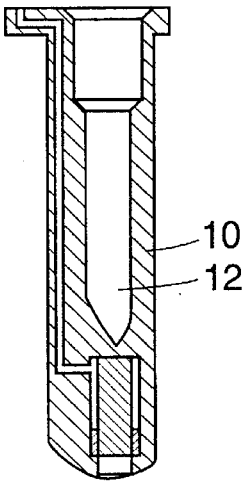
FIG. 1 is a cross-sectional view of a conventional lipstick mold utilized in connection with the manufacture of an exact-likeness facsimile manufactured in accordance with the present invention.

The present invention employs a quantity of the actual formulation of a given cosmetic product in combination with a thermoplastic vinyl copolymeric, hardening agent, and a hydrocarbonous-based temperature control component. The foregoing ingredients, in prescribed ratios, are slowly admixed, at a controlled temperature, to produce a homogeneous, moldable composition. Accordingly, it is imperative that the thermoplastic hardening agent be compatible with the cosmetic product composition and be capable of being melted within a temperature range in which the various components, such as fragrances, pigments and the like comprising the cosmetic product, will not thermally decompose. The novel combination of the cosmetic product formulation, the thermoplastic, vinyl copolymeric hardening agent, and the hydrocarbonous-based temperature control component can provide a wide range of molded, exact-likeness facsimiles of the original cosmetic products which are to be replicated. The molded facsimile products manufactured in accordance with this invention are identical in many, if not all, respects to the replicated products, except they will not yield a payoff. For example, in the case of a lipstick, the facsimile thereof will not only display the true color but will also be identical in size and shape to that of the original lipstick product.

The procedural steps for preparing exact-likeness cosmetic product facsimiles according to the present invention involve: combining a quantity of the formulation of the original cosmetic product, the thermoplastic, copolymeric hardening agent, and a hydrocarbonous-based temperature control component; stirring and heating the mixture until all of the ingredients melt; molding the resultant homogeneous molten mixture into a desired configuration; and cooling the thusly molded facsimile. Consistent with the foregoing procedure, a typical lipstick shaped facsimile could be produced by admixing about 50 parts, by weight, of a conventional lipstick formulation with about 25 parts, by weight, of an ethylene vinylacetate copolymer, and about 25 parts, by weight, of ceresin wax; heating the mixture to about 95° C or to the temperature at which all of the components become fluid; pouring the resultant melt into a conventional lipstick mold; and thereafter cooling the molded configuration by suitable means such as a "chilling table". Upon removal from the mold, the resultant facsimile does not yield a payoff, yet otherwise, is an exact-likeness, particularly, with respect to true color, size, and shape, of the original lipstick product. Accordingly, the procedural steps and amounts for the preparation of a facsimile of any other cosmetic products such as an eyeliner pencil would be the same, except the formulation of the respective core of the eyeliner pencil would be utilized in place of that of the actual lipstick product.

Regarding the ratios of the three basic ingredients utilized in the practice of this invention, the original formulation of the cosmetic product can range from about 10 to about 50 percent, by weight, of the total composition. The quantity of the thermoplastic copolymer hardening agent and the hydrocarbonous-based temperature control component are each present in approximately equal amounts of about half that of the formulation of said original cosmetic product. More precisely, an ideal composition would comprise about 50 percent, by weight, of the formulation of the original cosmetic product and about 25 percent, by weight, each of the thermoplastic hardening agent and the hydrocarbonous-based temperature control component.

As mentioned hereinabove, the vinyl copolymers useful in the practice of this invention must have a melting temperature below that at which the pigment component(s) and any other thermally sensitive ingredients in the formulation of the actual cosmetic product would decompose. In addition to being compatible with the various components comprising the original cosmetic product, the particular vinyl copolymer can be selected on the basis of the ring and ball test, i.e. softening point of the mono-substituted vinyl comonomer content and the melt index thereof.

Various standard test methods suitable for evaluating the rheological properties of the thermoplastic, copolymeric hardening agents in this invention include those such as, inter alia, a softening point and melt index as mentioned hereinabove, melt elasticity, and shear response. Also, included among these standard test methods is that for determining the Melt Flow Rate of resin based on ASTM D1238. The foregoing test method essentially involves placing a prescribed amount of the test resin, i.e. thermoplastic material, into a cylinder which is provided with a plunger and a means of heating the test resin and then measuring the amount of melted test material, in grams, which drops over a ten minute period. The numerical value reflective of the respective melt index is then determined by correlating the equivalent value of the Melt Flow Index. An additional test useful in evaluating the suitability of a thermoplastic material for use in the present invention is that designed to obtain softening point values in degrees Fahrenheit. The foregoing test method is a standard method identified as ASTM E28.

Among the thermoplastic materials which are useful as hardening agents, in the present invention, are included those copolymers formed with ethylene and a mono-substituted vinyl comonomer having a characteristic functional group attached thereto and, which meet the formulation compatibility and the thermal property requirements discussed hereinabove. Included among such useful thermoplastic materials are copolymers of ethylene and a mono-substituted comonomer selected from the group consisting of vinylacetate, propylene, ethylene glycol dimethacrylate, acrylonitrile, N-vinylpyrrolidone.

The hydrocarbonous-based compounds useful as temperature control components include those which are capable of altering the melt temperature of the formulation of the original cosmetic product to a level more compatible with that of the particular thermoplastic copolymeric hardening agent utilized. Such compounds which can, at times, also function as supplemental hardeners include mineral oil, ceresin wax, candelilla wax, beeswax, ozokerites, paraffins, synthetic waxes, hydrogenated castor oil, spermaceti, cetyl alcohol, and stearyl alcohol.

While the present invention is applicable to many different industries wherein thermally molded or otherwise compressed products are prepared, it is especially useful in the production of molded display facsimiles of cosmetic products such as lipsticks, powders, eyeliner pencils, and cream eyemarkers. Accordingly, the present invention will be described hereinbelow in connection with the preparation of exact-likeness display facsimiles of molded lipsticks.

Referring to FIG. 1, a conventional lipstick mold 10 contains a predetermined quantity of molten lipstick facsimile composition 12, which has been prepared in accordance with the present invention. Upon its solidification, the facsimile composition 12 will assume the exact shape of the lipstick which it is intended to replicate.

Figure 2:
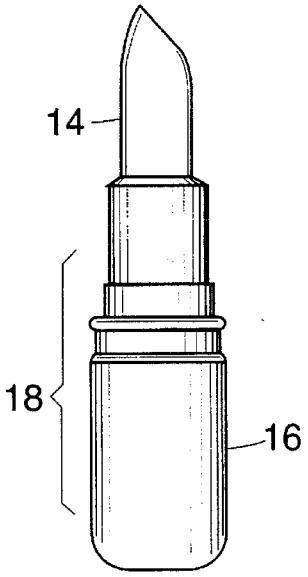
FIG. 2 is an elevational view of a completely finished lipstick display facsimile manufactured in accordance with the present invention.

FIG. 2 illustrates a completely finished lipstick-shaped facsimile 14 after its removal from the mold 10 shown in FIG. 1. The facsimile 14 is shown mounted in a base 16 of a conventional lipstick dispenser to form a lipstick display 18.

Figure 3:
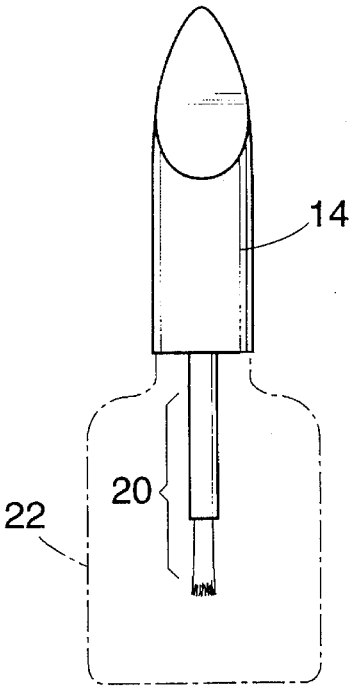
FIG. 3 is an elevational view of a nail enamel brush having a handle in the form of an exact-likeness facsimile manufactured in accordance with the present invention, an associated container being shown in phantom to facilitate consideration and discussion.

In FIG. 3, the facsimile 14 is shown as a handle for a nail enamel brush 20. The facsimile 14 also functions as the closure for a bottle 22 (shown in phantom) containing the nail enamel.

Figure 4:
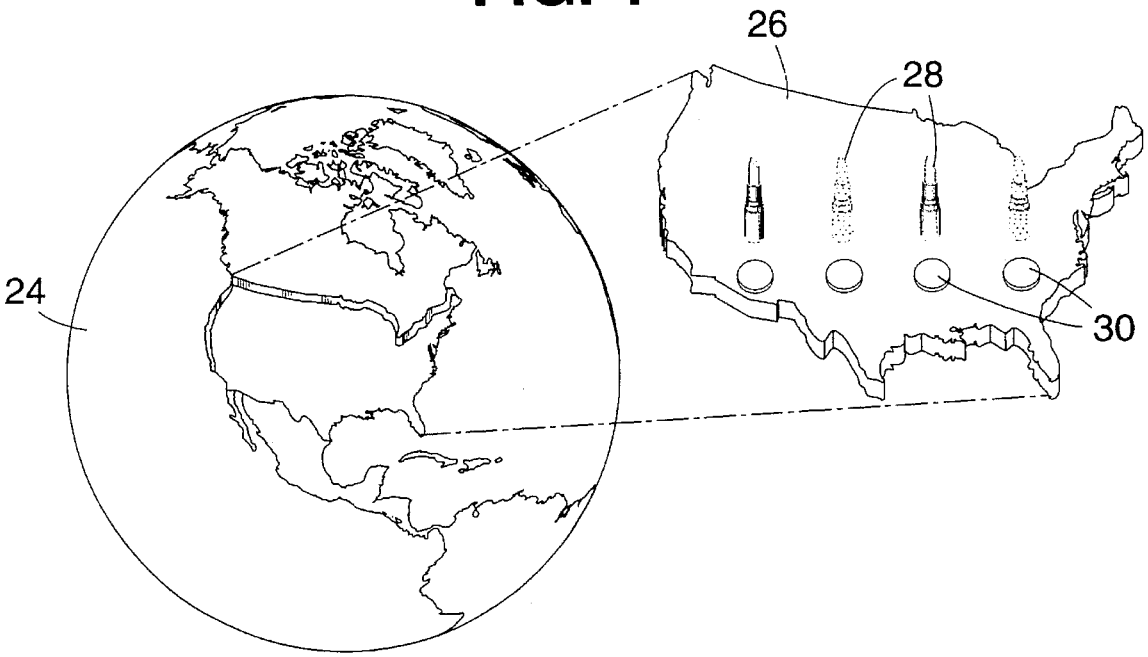
FIG. 4 is an exploded view of a topographic cosmetic product display manufactured in accordance with the present invention. Consistent with the illustration in FIG. 4, numerous additional products can be displayed.

Referring now to FIG. 4, a three-dimensional display 24 in the form of a globe contains a topographical relief 26 in the shape of the United States. The topographical relief 26 contains a series of lipstick displays 28, each of which is manufactured in a manner similar to that of the lipstick display 18 shown in FIG. 2, as well as a series of compressed powder compact displays 30. It is noted that the coloration of the lipstick displays 28 and the compressed powder compact displays 30 can vary from series to series or within a particular series.

The following examples further illustrate certain aspects of the present invention and are not intended to limit the scope thereof.

EXAMPLE 1

A series of exact-likeness facsimiles of a hydrocarbonous-based lipstick product were prepared, in accordance with this invention. A conventional lipstick formulation and the technique for the preparation thereof were utilized to form the moldable pomade to which amounts of the thermoplastic hardening agent and the temperature control component, consistent with the present invention, were added. The lipstick-based formulation essentially comprised about 65 percent, by weight, of mineral oil, about. 20 percent of candelilla wax, 5 percent of a fatty material, about 5 percent of a polyhydroxyalcohol, and about 5 percent of a color additive.

The above-described components were admixed, under slow agitation and heating, in a jacketed kettle provided with both agitation and heating means, to insure thorough melting and blending. Upon completion of melting and blending, a conventional perfume was added to the melt, as agitation continued at about 70° Centigrade. Thereafter the temperature was adjusted and maintained at about 90'–110° Centigrade, as a prescribed amount of ethylene vinylacetate (EVA) and the hydrocarbonous-based temperature control component were stirred into the melt contents of the kettle. In this instance, a paraffin wax was utilized as a temperature control component. The respective amounts of the EVA and the paraffin wax were each approximately 25 percent, by weight, of that of the total of the original melt blend.

Quantities of the above-described hot, modified lipstick pomade were then utilized to prepare exact-likeness lipstick facsimiles as defined by this invention, using molds similar to the mold shown in the FIG. 1 hereinabove, in a conventional automatic lipstick molding system. Subsequent to being cooled on a "chilling table", the thusly molded lipstick facsimiles were removed from the mold and inserted into conventional lipstick bases as shown in FIG. 2.

Upon comparison to a conventional non-modified lipstick comprised of the original formulation without a hardening agent, it was observed that the lipstick facsimiles displayed a color truly identical to that of said non-modified lipstick. It was further observed that the surfaces of the respective lipstick facsimiles were uniformly smooth and identical, in all other respects, to that of the conventional, non-modified lipstick. The lipstick facsimiles were subsequently evaluated on the basis of their physical properties such as hardness and inability to yield a payoff. Accordingly, it was determined that the thusly prepared lipstick facsimiles possessed the desired characteristics of hardness and an inability to yield a payoff.

EXAMPLE II

An additional quantity of the moldable, lipstick pomade prepared in Example I, supra, and a number of modified molds were utilized to prepare a series of lipstick facsimiles having fluted surfaces. The procedural steps set forth in Example I were all repeated, except that the cavities of the molds employed were designed to yield lipstick-shaped facsimiles in which the surfaces thereof have the aforesaid fluted configurations.

Upon being removed from the molds and inserted into conventional lipstick bases, such as that shown in FIG. 2, the thusly obtained lipstick facsimiles displayed desired physical characteristics comparable to those of the facsimiles obtained in Example I above.

EXAMPLE III

The procedural steps set forth in Example I hereinabove were repeated to prepare exact-likeness facsimiles, according to this invention, using a conventional lipstick formulation having a thermally sensitive pigment component therein. The ingredients and the respective proportionate amounts thereof were the same as those in the lipstick pomade prepared in the aforesaid example, except the pigment component herein comprised about 5 percent, by weight, of the lipstick formulation.

The moldable lipstick-based composition comprised, by weight, of the total thereof, 50 percent of the above-described lipstick pomade, and 25 percent each of EVA as a hardening agent and ceresin wax as a temperature control component.

Subsequent to being removed from the mold and inserted into lipstick bases similar to that shown in FIG. 2, the resultant lipstick facsimiles exhibited the true color of the original lipstick from which the basic formulation was obtained and, other desired physical characteristics comparable to the display products respectively obtained in Examples I and II, supra.

The cosmetic product facsimiles obtained in accordance with Examples I–III are characterized by their uniformly smooth and glossy surfaces which do not yield a payoff and, their resistance to atmospheric conditions. As a result of their capability to exhibit the true color of the original cosmetic product and their inability to yield a payoff, the facsimiles obtained according to this invention make excellent, virtually permanent display samples which cannot be tested by the consumer. In fact, the novel cosmetic product facsimiles defined herein appear so real that they are capable of inducing the consumer to make a purchase based on color alone.

Based on the disclosure set forth hereinabove, it will be understood that the embodiments described herein are merely exemplary. It will become apparent to those skilled in the art that various modifications in procedures, proportions, and materials may be made, without departing from the spirit and scope of the invention. All such modifications and variations are intended to be included within the scope of the invention as defined by the following claims.

What is claimed is:

1. A lipstick display facsimile manufactured by a method comprising the steps of:

(a) combining, by weight of the total composition, 5.0–50% lipstick formulation, 25–47.5% of a thermoplastic copolymeric hardening agent which is a copolymer of ethylene and a mono-substituted vinyl comonomer, and 25–47.5% of a hydrocarbonous based temperature control component, while heating to a temperature below that at which the lipstick pigments thermally degrade;

(b) pouring the molten mixture of (a) into molds and allowing to cool;

whereby the resulting molded product has no payoff and is an exact color likeness of the lipstick formulation.

2. The facsimile of claim 1 wherein the composition is heated to a temperature below 110° C.

3. The facsimile of claim 2 wherein the thermoplastic copolymeric hardening agent is a copolymer of ethylene and a mono-substituted vinyl comonomer selected from the group consisting of vinyl acetate, methylmethacrylate, ethylene glycol dimethacrylate, acrylonitrile, and N-vinylpyrrolidone.

4. The facsimile of claim 3 wherein the hydrocarbonous based temperature control component is selected from the group consisting of mineral oil, candelilla wax, beeswax, ozokerites, paraffins, synthetic waxes, hydrogenated castor oil, spermaceti, cetyl alcohol, stearyl alcohol, and mixtures thereof.

5. The facsimile of claim 4 wherein the lipstick formulation comprises, by weight of the lipstick formulation, about 65% mineral oil, 20% candelilla wax, 5 percent fatty material, 5% polyhydroxyalcohol, and 5 percent color.

6. The facsimile of claim 5 comprising about 10 percent lipstick formulation.

* * * * *